US006676388B2

(12) United States Patent
Lee et al.

(10) Patent No.: US 6,676,388 B2
(45) Date of Patent: Jan. 13, 2004

(54) GAS COMPRESSION APPARATUS FOR RECIPROCATING COMPRESSOR

(75) Inventors: Hyeong Kook Lee, Gunpo (KR); Jong Tae Heo, Bucheon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/035,174

(22) Filed: Jan. 4, 2002

(65) Prior Publication Data

US 2003/0035743 A1 Feb. 20, 2003

(30) Foreign Application Priority Data

Aug. 17, 2001 (KR) ..... 2001-49573

(51) Int. Cl.[7] ..... F04B 17/04; F04B 35/04

(52) U.S. Cl. ..... 417/417; 417/415; 417/440; 417/441; 417/545

(58) Field of Search ..... 417/417, 415, 417/416, 545, 570, 440, 441

(56) References Cited

U.S. PATENT DOCUMENTS 6,089,836 A * 7/2000 Seo ..... 417/417
6,174,141 B1 * 1/2001 Song et al. ..... 417/312
6,202,791 B1 * 3/2001 Oh et al. ..... 184/6.16
6,398,523 B1 * 6/2002 Hur et al. ..... 417/417
6,413,057 B1 * 7/2002 Hong et al. ..... 417/416
6,435,842 B2 * 8/2002 Song ..... 417/363

* cited by examiner

*Primary Examiner*—Charles G. Freay
*Assistant Examiner*—William H. Rodriquez
(74) *Attorney, Agent, or Firm*—Birch, Stewart, Kolasch & Birch, LLP

(57) ABSTRACT

A gas compression apparatus for a reciprocating compressor includes a reciprocating motor generating a linear reciprocal driving force, a compressing cylinder positioned within a predetermined distance from the reciprocating motor, a position controlling cylinder positioned within a predetermined distance from the compressing cylinder, an initial position variable type piston inserted into the compressing cylinder and the position controlling cylinder, and being linearly and reciprocally moved within the compressing cylinder and the position controlling cylinder, and a pressure controlling valve controlling a pressure inside the position controlling cylinder with the pressure of the gas discharged from the discharge chamber. The gas compression amount can be controlled by controlling the stroke distance of the initial position variable type piston according to the voltage control of the motor, an efficiency of the system can be heightened by preventing a refrigerant gas compression loss, and an efficiency of the compressor can be improved.

4 Claims, 5 Drawing Sheets

GAS COMPRESSION APPARATUS FOR RECIPROCATING COMPRESSOR

BACKGROUND OF THE INVENTION

1. Field of the Invention

The present invention relates to a gas compression apparatus for reciprocating compressor, and more particularly, to a gas compression apparatus for reciprocating compressor that is capable of controlling a piston stroke distance to control a compression amount of a compressed refrigerant gas and capable of minimizing a dead volume.

2. Description of the Background Art

In general, a compressor compresses a fluid. A reciprocating compressor of the present invention is operated that a piston directly connected to a motor which generates a linear reciprocal driving force is linearly and reciprocally moved within a cylinder, so as to compress a refrigerant gas.

As shown in FIG. 1, the reciprocating compressor includes a closed container 10, a reciprocating motor 20 installed in the closed container 10 and generating a linear reciprocal driving force, a rear frame 30 and a middle frame 40 respectively supporting both sides of the motor 20, a front frame 50 coupled to one side of the middle frame 40, a cylinder 60 for being coupled to the front frame 50 to have a predetermined distance along an axial direction with the reciprocating motor 20; a piston 70 connected to the reciprocating motor 20 and inserted into the cylinder 60, making a linear reciprocal movement in the cylinder 60 upon receiving the linear reciprocal driving force of the reciprocating motor 20; a valve assembly 80 combined to the cylinder 60 and the piston 70 and sucking and discharging gas into the cylinder according to a pressure difference generated by the reciprocation movement of the piston 70; and a resonance spring unit 90 elastically supporting the linear reciprocal movement of the reciprocating motor 20 and the piston 70.

The reciprocating motor 20 includes a cylindrical outer stator 21 fixedly coupled to the rear frame 30 and the middle frame 40; an inner stator 22 inserted into the outer stator 21 with a certain distance; a winding coil 23 wound inside the outer stator 21; and an armature (A) inserted to be linearly and reciprocally movable between the outer stator 21 and the inner stator 22 with a certain distance, respectively.

The armature (A) includes a cylindrical magnet holder 24, and a plurality of permanent magnets 25 coupled to the outer circumferential face of the magnet holder 24 along the circumferential direction at regular intervals. The armature (A) is coupled to the piston 70.

The resonance spring unit 90 includes a support 91 formed bent to have a predetermined area, one side thereof being coupled to one face of the piston 70 or the armature (A) so that the support can be positioned between the front frame 50 and the middle frame 40, a front spring 92 positioned between the front frame 50 and the support 91, and a rear spring 93 positioned between the support 91 and the middle frame 40.

The valve assembly 80 includes a discharge cover 81 covering the compression space (P) of the cylinder 60, a discharge valve 82 being positioned inside the discharge cover 81 and opening and closing the compression space (P) of the cylinder 60, a valve spring 83 elastically supporting the discharge valve 82, and a suction valve 84 coupled at an end portion of the piston 70 and opening and closing a refrigerant suction passage (F) formed in the piston 70.

A discharge pipe 2 is coupled at one side of the discharge cover 81 to guide gas compressed to a high temperature and high pressure to be discharged, and a suction pipe 1 for guiding the refrigerant gas to be introduced into the closed container 10 is coupled at one side of the closed container 10 so as to be positioned at the side of the rear frame 30.

The operation of the conventional reciprocating compressor constructed as described above will now be explained.

First, when current flows through the winding coil 23 as a power is supplied to the reciprocating motor 20, the armature (A) having the permanent magnet 25 is linearly and reciprocally moved owing to the interaction between the magnetic flux formed at the outer stator 21 and the inner stator 22 by the current flowing through the winding coil 23 and the permanent magnet 25.

As the linear reciprocal driving force of the armature (A) is transferred to the piston 70, the piston 70 is linearly and reciprocally moved in the compression space (P) inside the cylinder, and at the same time, the valve assembly 80 is operated so that gas is sucked into the compression space (P) of the cylinder, compressed and discharged. And this process is repeatedly performed.

The spring unit 90 stores and discharges the linear reciprocal kinetic movement force of the reciprocating motor 20 as an elastic energy and causes a resonance movement.

As shown in FIG. 2, the reciprocating compressor is assembled with its initial position (a) set in such a manner that the end portion of the piston 70 positioned inside the cylinder 60 is positioned at the center of a maximum upper dead point ($H_{max}$) and a maximum lower dead point ($L_{max}$), of which the distance between the two points is a maximum stroke distance ($S_{max}$).

In general, as a voltage of a power is controlled, an arbitrary stroke distance (S1) between an arbitrary upper dead point (H1) and an arbitrary lower dead point (L1) is moved with reference to the initial position (a), the right center of the maximum upper dead point ($H_{max}$) and the maximum lower dead point ($L_{max}$), so as to compress the refrigerant gas.

That is, in case where a relatively much amount of refrigerant gas is to be compressed and discharged in the compression space (P) of the cylinder 60, as shown in FIG. 3, the stroke distance (S2) of the piston 70 is increased, though shorter than the maximum stroke distance ($S_{max}$), to increase the amount of the compressed refrigerant gas.

Meanwhile, if a relatively small amount of refrigerant gas is to be compressed and discharged in the compression space (P) of the cylinder 60, as shown in FIG. 4, the stroke distance (S3) of the piston 70 is made to be smaller.

At this time, the piston is moved on the basis of the initial position (a), the right center of the maximum upper dead point ($H_{max}$) and the maximum lower dead point ($L_{max}$). Thus, if the stroke distance of the piston 70 is made to be larger, the distance between the upper dead point 70 of the piston and the bottom surface of the discharge valve 82, that is, a top-clearance, is shortened. Meanwhile, if the stroke distance of the piston 70 is made to be smaller, the top-clearance, that is, the distance between the upper dead point 70 of the piston and the discharge valve 82, is lengthened.

However, though the conventional structure has an advantage in that the compression amount of the refrigerant gas can be controlled by controlling the stroke distance of the piston under the voltage control, so that the gas can be compressed as much as desired, since the piston is always moved along the stroke distance set on the basis of the initial position, the middle between the maximum upper dead point and the maximum lower dead point, the top-clearance is increased. Due to the increased top-clearance, a dead volume is increased, degrading a compression efficiency.

SUMMARY OF THE INVENTION

Therefore, an object of the present invention is to provide a gas compression apparatus for reciprocating compressor that is capable of controlling a piston stroke distance for a compression amount control of a refrigerant gas and capable of minimizing a dead volume.

To achieve these and other advantages and in accordance with the purpose of the present invention, as embodied and broadly described herein, there is provided a gas compression apparatus for reciprocating compressor including: a reciprocating motor generating a linear reciprocal driving force; a compressing cylinder positioned with a predetermined distance from the reciprocating motor; a position controlling cylinder positioned with a predetermined distance from the compressing cylinder; an initial position variable type piston inserted into the compressive cylinder and the position controlling cylinder, coupled to the reciprocating motor, receiving a driving force of the reciprocating motor and being linearly and reciprocally moved within the compressing cylinder and the position controlling cylinder; a resonance spring including a resonance movement of the initial position variable type piston; a discharge cover coupled to cover an end portion of the compressing cylinder and forming a discharge chamber for discharging a compressed gas; a valve unit for sucking gas into the compressing cylinder through a gas suction passage formed inside the initial position variable type piston according to the linear reciprocating movement of the initial position variable type piston and discharging the gas compressed in the compressing cylinder into the discharge chamber of the discharge cover; a connection pipe for guiding a portion of the gas pressure discharged into the discharge chamber of the discharge cover to be introduced into the position controlling cylinder; and a pressure controlling unit being mounted at one side of the connection pipe and controlling a pressure inside the position controlling cylinder with the pressure of the gas discharged from the discharge chamber.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
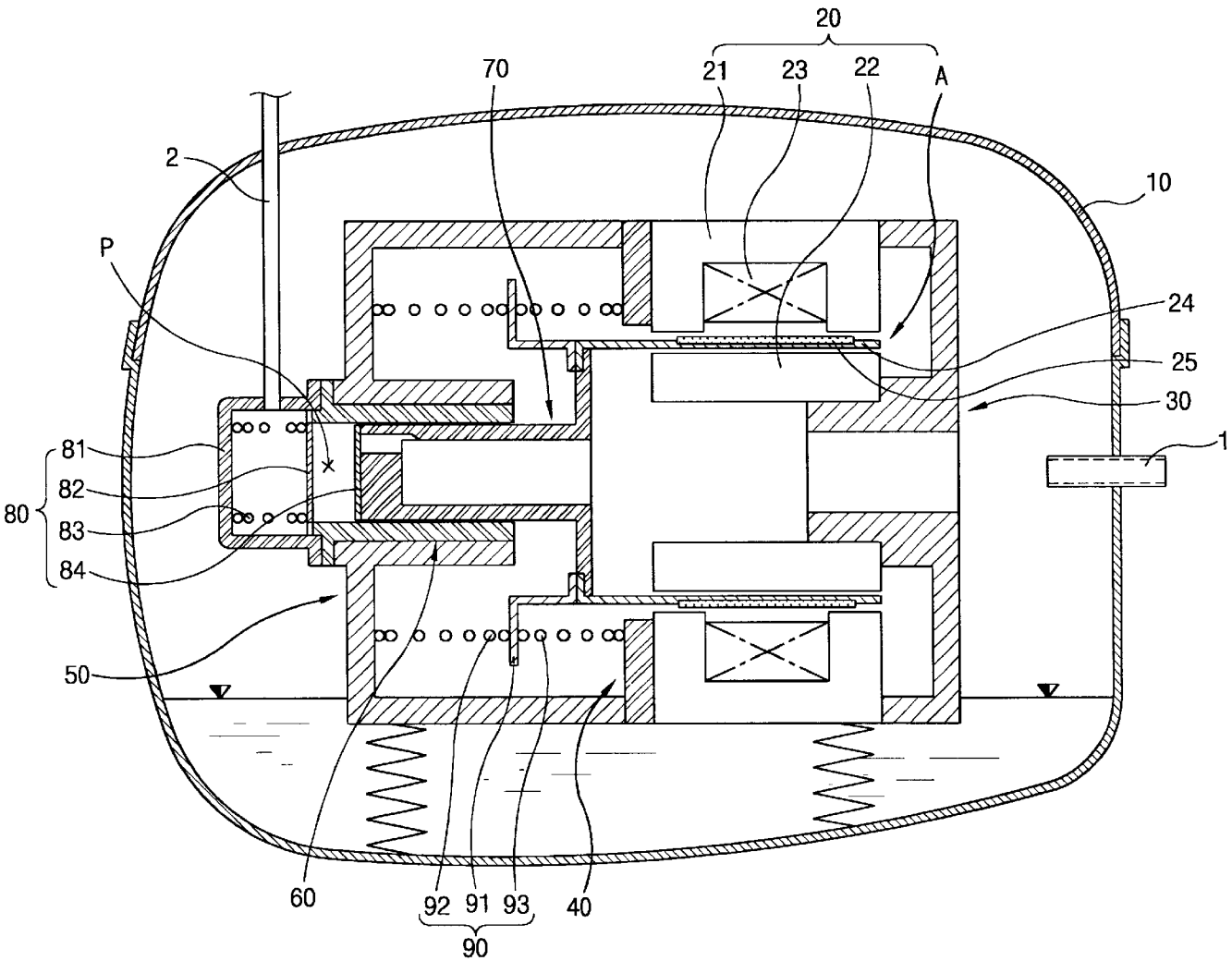
FIG. 1 CONVENTIONAL ART
FIG. 1 is a vertical-sectional view showing a reciprocating compressor in accordance with a conventional art.
Figure 2:
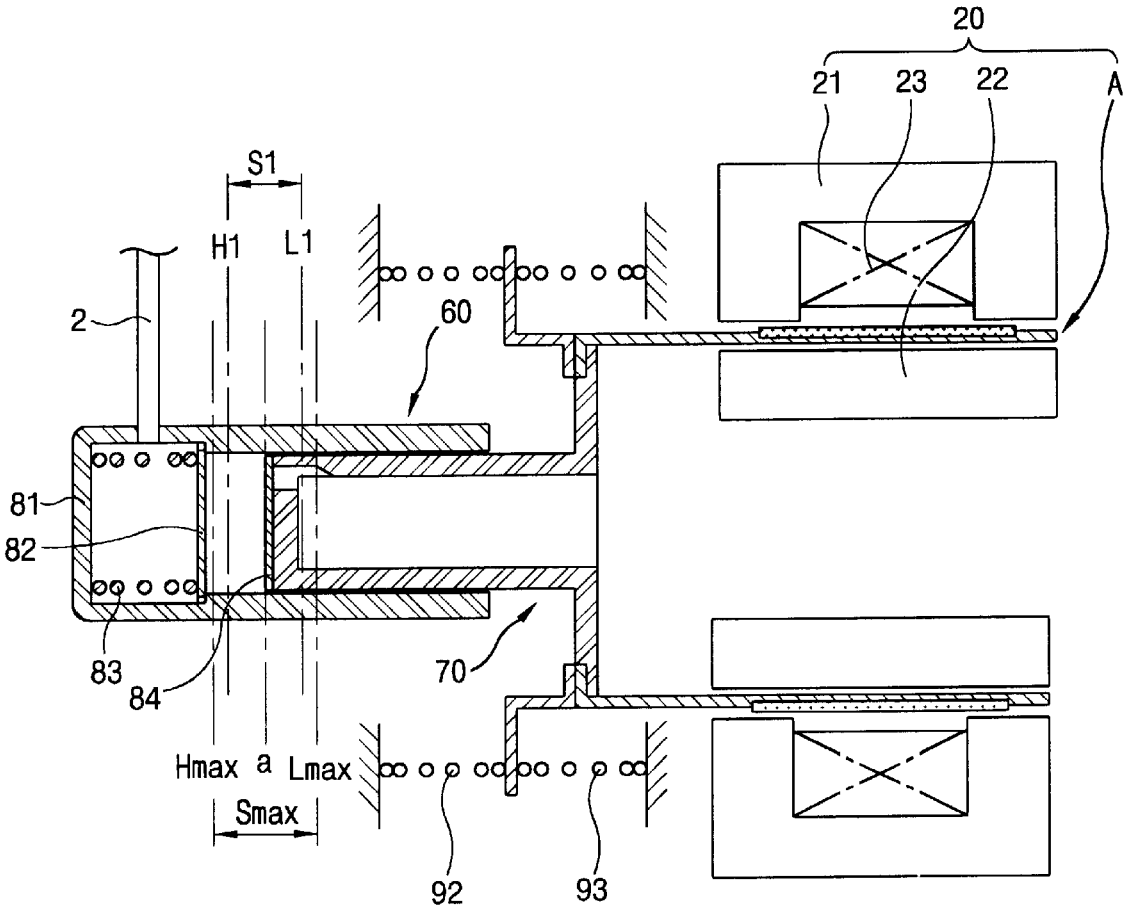
FIG.2 CONVENTIONAL ART
FIG. 2 is a sectional view showing a maximum upper dead point, a maximum lower dead point and an arbitrary stroke distance (S1) of the movement of a piston when the reciprocating compressor compresses a refrigerant gas of a compressor in accordance with the conventional art.
Figure 3:
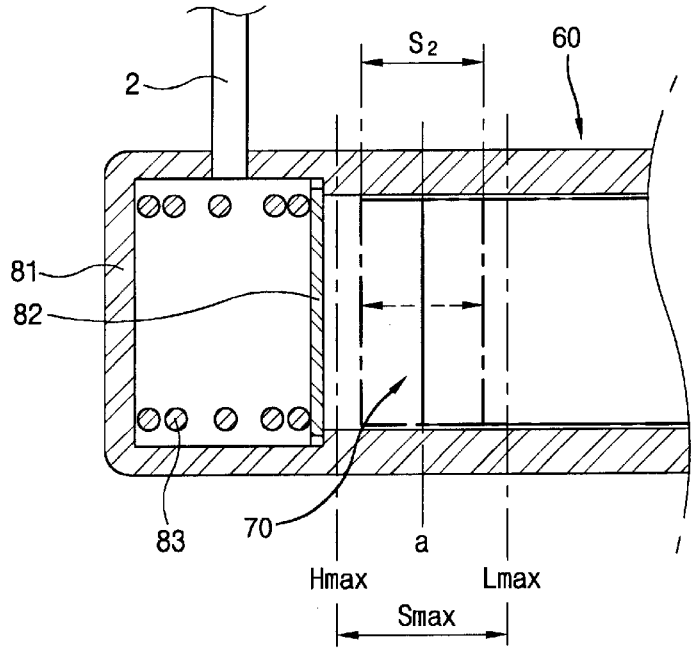
FIG.3 CONVENTIONAL ART
FIG. 3 is a sectional view showing a stroke distance (S2) of the movement of the piston if a relatively much amount of the refrigerant gas is compressed in accordance with the conventional art.
Figure 4:
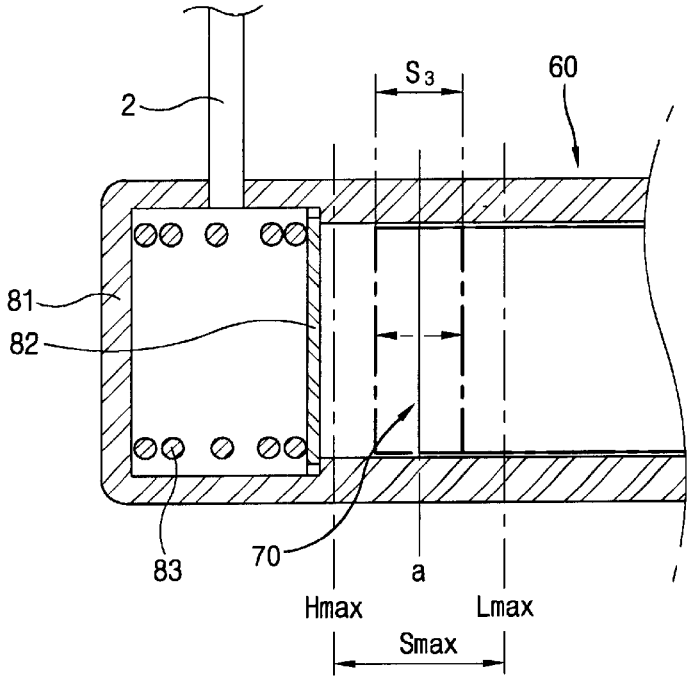
FIG.4 CONVENTIONAL ART
FIG. 4 is a sectional view showing a stroke distance (S3) of the movement of the piston if a relatively small amount of the refrigerant gas is compressed in accordance with the conventional art.
Figure 5:
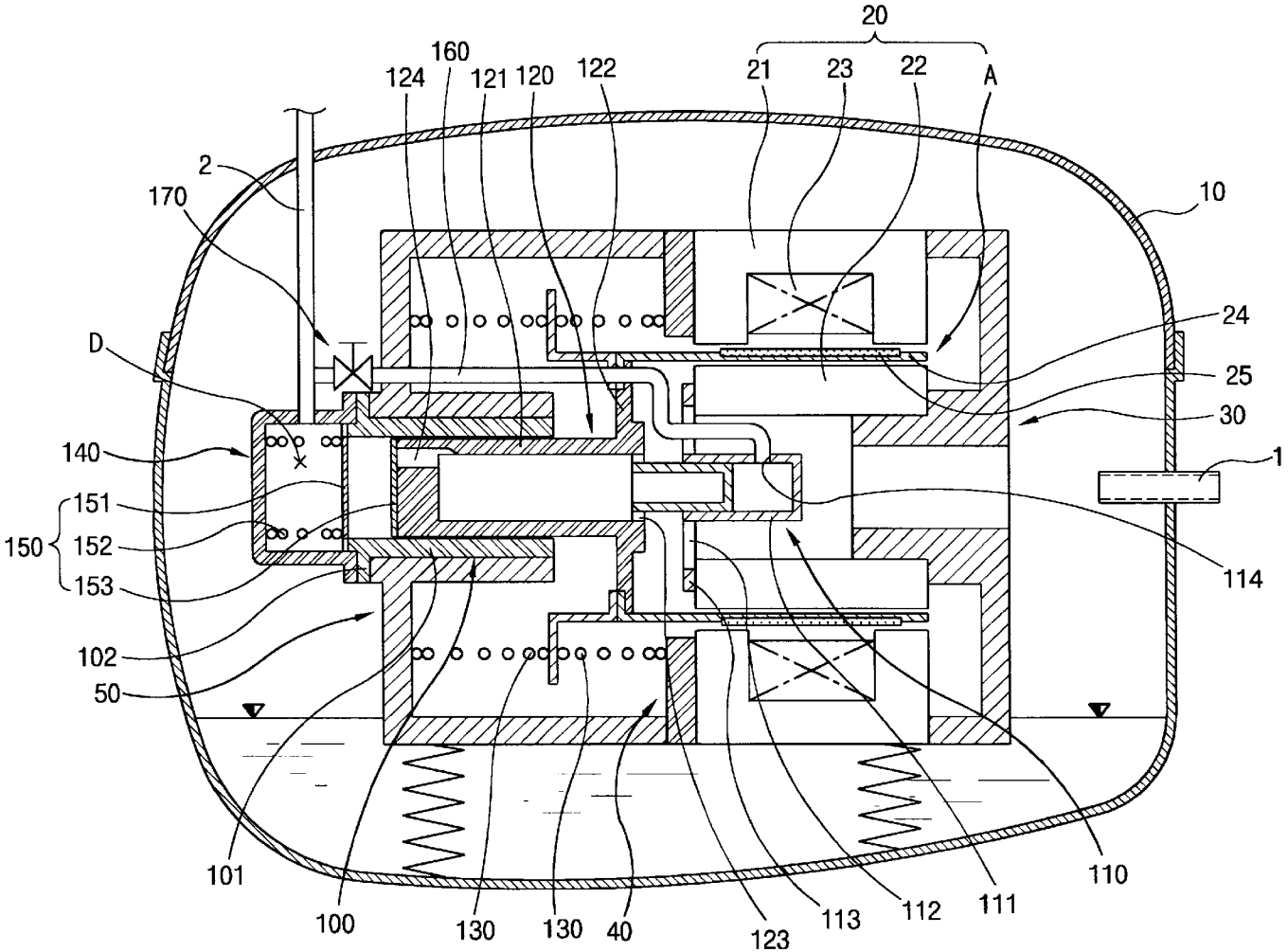
FIG. 5 is a vertical-sectional view showing a reciprocating compressor having a gas compression apparatus in accordance with a preferred embodiment of the present invention.

FIG. 5 is a vertical-sectional view showing a reciprocating compressor having a gas compression apparatus in accordance with a preferred embodiment of the present invention.

First, as shown in FIG. 5, in a reciprocating compressor, a reciprocating motor 20 is mounted in a container 10 having a predetermined internal space to generate a linear reciprocal driving force, and a rear frame 30 and a middle frame 40 are coupled at both sides of the reciprocating motor 20.

The reciprocating motor 20 includes a cylindrical outer stator 21 fixedly coupled at the rear frame 30 and the middle frame 40, an inner stator 22 inserted into the outer stator 21 with a certain distance therefrom, a winding coil 23 coupled to the outer stator 21, and an armature (A) inserted to be linearly and reciprocally movable between the outer stator 21 and the inner stator 22.

The inner stator 22 is formed to have a cylindrical with a predetermined thickness and width.

The armature (A) includes a cylindrical magnet holder 24 and a plurality of permanent magnets 25 coupled to the magnet holder 24 with a predetermined distance.

A front frame 50 having a predetermined form is coupled to the middle frame 40, and a compressing cylinder 100 is coupled into a through hole formed penetrating in the front frame 50.

A initial position controlling cylinder 110 is coupled at the inner stator 22 of the reciprocating motor, and the initial position variable type piston 120 inserted into the compressing cylinder 100 and the initial position controlling cylinder 110 is coupled to the armature (A) of the reciprocating motor 20.

The compressing cylinder 100 includes a cylinder body portion 101 with a predetermined length and a step portion 102 formed extended at an end portion of the cylinder body portion 101 to have a predetermined width and height.

The cylinder body portion 101 of the compressing cylinder 100 is inserted into the through hole of the front frame and the step portion 102 is engaged at the end portion of the front frame 50.

The initial position variable type piston 120 includes a cylindrical body portion 121 having a predetermined length with both ends closed, the both ends being inserted into the compressing cylinder 100 and inserted into the initial position controlling cylinder 110, a connection support 122 formed to have a predetermined area to an outer circumference surface of the cylindrical body portion 121, and a refrigerant gas suction passage having a suction hole 123 formed at one side of the cylindrical body portion 121 and an outflow hole 124 through which the refrigerant gas sucked into the suction hole 123 is introduced into the compressing cylinder 100 through the cylindrical body portion 121.

In the initial position controlling cylinder 110, the attachment portion 113 is fixedly attached to the side of the inner stator 22 in a state that the body 111 is positioned inside the inner stator 22.

The initial position variable type piston 120 includes a cylindrical body portion 121 having a predetermined length with both ends closed, the both ends being inserted into the compressing cylinder 100 and inserted into the initial position controlling cylinder 110, a connection support 122 formed extended to have a predetermined area to an outer circumference surface of the cylindrical body portion 121, and a refrigerant gas suction passage having a suction hole 123 formed at one side of the cylindrical body portion 121 and an outflow hole 124 through which the refrigerant gas sucked into the suction hole 123 is introduced into the compressing cylinder 100 through the cylindrical body portion 121.

As for the initial position variable type piston 120, the side of the cylindrical body portion 121 where the outflow hole 124 is formed is inserted into the compressing cylinder 100, the opposite side of the cylindrical body portion 121 is inserted into the initial position controlling cylinder 110, and the connection support 122 is coupled to the armature (A) of the reciprocating motor 20.

A plurality of resonance springs 130 supporting the initial position variable type piston 120 are positioned at both sides of the connection support 122 of the initial position variable type piston 120.

That is, the plurality of resonance springs 130 are coupled between one face of the connection support 122 of the initial position variable type piston 120 and the middle frame 40, the plurality of resonance springs 130 is coupled between the outer face of the connection support 122 of the initial position variable type piston 120 and the front frame 50.

A discharge 140 is coupled at an end portion of the compressing cylinder 100 to cover the compressing cylinder 100. The discharge cover 140 forms a discharge chamber (D) for discharging the refrigerant gas compressed in the compressing cylinder 100.

A valve unit 150 is provided to suck the gas into the compressing cylinder 100 through the gas suction passage formed inside the initial position variable type piston 120 according to the linear reciprocal movement of the initial position variable type piston 120 and to discharge the gas compressed in the compressing cylinder 100 to the discharge chamber (D) of the discharge cover 140.

The valve unit 150 includes a discharge valve 151 positioned inside the discharge cover 140 to open and close the internal space of the compressing cylinder 100, a valve spring 152 elastically supporting the discharge valve 151, and a suction valve 153 coupled at an end portion of the initial position variable type piston 120 to open and close the outflow hole 124 formed inside the initial position variable type piston 120.

A discharge pipe 2 is coupled at one side of the discharge cover 140 to guide the high pressure gas discharged into the discharge chamber (D) to be discharged externally, and a connection pipe 160 is coupled to guide a portion of the refrigerant gas discharged into the discharge pipe 2 to be introduced into the initial position controlling cylinder 110.

The connection pipe 150 includes a pressure control valve 170 formed at one side thereof, which can control a pressure of the refrigerant gas introduced into the initial position controlling cylinder 110.

It is preferred that, as the pressure control valve 170, an electronic valve that can be moved in three directions to pass the direction of a passage.

Reference numeral 1 denotes a suction pipe for introducing the refrigerant gas.

The operational effect of the gas compression apparatus for reciprocating compressor of the present invention will now be described.

First, when current flows through the winding coil 23 as a power is supplied to the reciprocating motor 20, the armature (A) having the permanent magnet 25 is linearly and reciprocally moved owing to the interaction between the magnetic flux formed at the outer stator 21 and the inner stator 22 by the current flowing through the winding coil 23 and the permanent magnet 25.

As the linear reciprocal driving force of the armature (A) is transferred to the initial position variable type piston 120, the initial position variable type piston 120 is linearly and reciprocally moved inside the compressing cylinder 100 and the initial position controlling cylinder 110, and at the same time, the valve unit 150 is operated so that the refrigerant gas is sucked into the internal space of the compressing cylinder 100, compressed and discharged. And this process is repeatedly performed.

At this time, the refrigerant gas is sucked into the compressing cylinder 100 in such a manner that the refrigerant gas sucked into the suction pipe 1 owing to a pressure difference inside the compressing cylinder 100 passes a through hole (not shown) penetratingly formed at the central portion of the rear frame 30 and sucked into the suction hole 123 of the initial position variable type piston 120 through the gas through hole 112 of the initial position controlling cylinder 110.

The refrigerant sucked into the suction hole 123 of the initial position variable type piston 120 passes the inside and sucked into the internal space of the compressing cylinder 100 through the outflow hole 124 formed at the end portion of the initial position variable type piston 120 and the suction valve 153.

The refrigerant gas discharged after being compressed in the compressing cylinder 100 passes the discharge chamber (D) of the discharge cover 140 and discharged externally through the discharge pipe 2, and a portion of the high pressure refrigerant gas discharge to the discharge pipe 2 is introduced into the internal space of the initial position controlling cylinder 110 through the connection pipe 160, so that a pressure of the internal space of the initial position controlling cylinder 110 is maintained in a pre-set pressure state to set an initial position of the initial position variable type piston 120. At this time, the pressure control valve 170 is in a state of being opened.

The plurality of resonance springs 130 stores and discharges the linear reciprocal movement force of the reciprocating motor 20 as an elastic energy, and at the same time, induces a resonance movement.

The initial position of the initial position variable type piston 120 is on the basis of the end portion of the initial position variable type piston 120 positioned inside the compressing cylinder 100, and the reference end portion of the initial position variable type piston 120 is positioned between the upper dead point and the lower dead point of the initial position variable type piston, that is, at the right center of the stroke distance.

Thereafter, after the initial position of the reference end portion of the initial position variable type piston 120 is positioned at an arbitrary reference position to be controlled, a voltage of power is controlled, thereby controlling the position of the upper dead point and the lower dead point of the initial position variable type piston 120, that is, the stroke distance.

As a result, if a relatively much amount of refrigerant gas is to be discharged, the stroke distance is controlled to be large, while if a relatively small amount of refrigerant gas is to be discharged, the stroke distance is controlled to be small.

When the opening degree of the connection pipe 160 is controlled at the same time when the power is controlled, a portion of the high pressure refrigerant gas discharged into the discharge pipe 2 after being discharged from the compressing cylinder 100 is introduced into the initial position controlling cylinder 110, to control the pressure inside the initial position controlling cylinder 110.

Accordingly, the initial position variable type piston 120 is moved into the compressing cylinder 100 owing to the pressure inside the initial position controlling cylinder 110, or moved into the initial position controlling cylinder 110 and reciprocally moved there.

The initial position controlling cylinder 110 serves as a gas spring thanks to the pressure of the refrigerant gas filled therein when the initial position variable type piston 120 is reciprocally moved.

In other words, in a state that an initial position of the initial position variable type piston 120 is moved to the compressing cylinder 100 according to the pressure state inside the initial position controlling cylinder 110, the initial position variable type piston 120 sucks, compresses and discharges the refrigerant gas while moving on the stroke distance controlled by the voltage.

Figure 6:
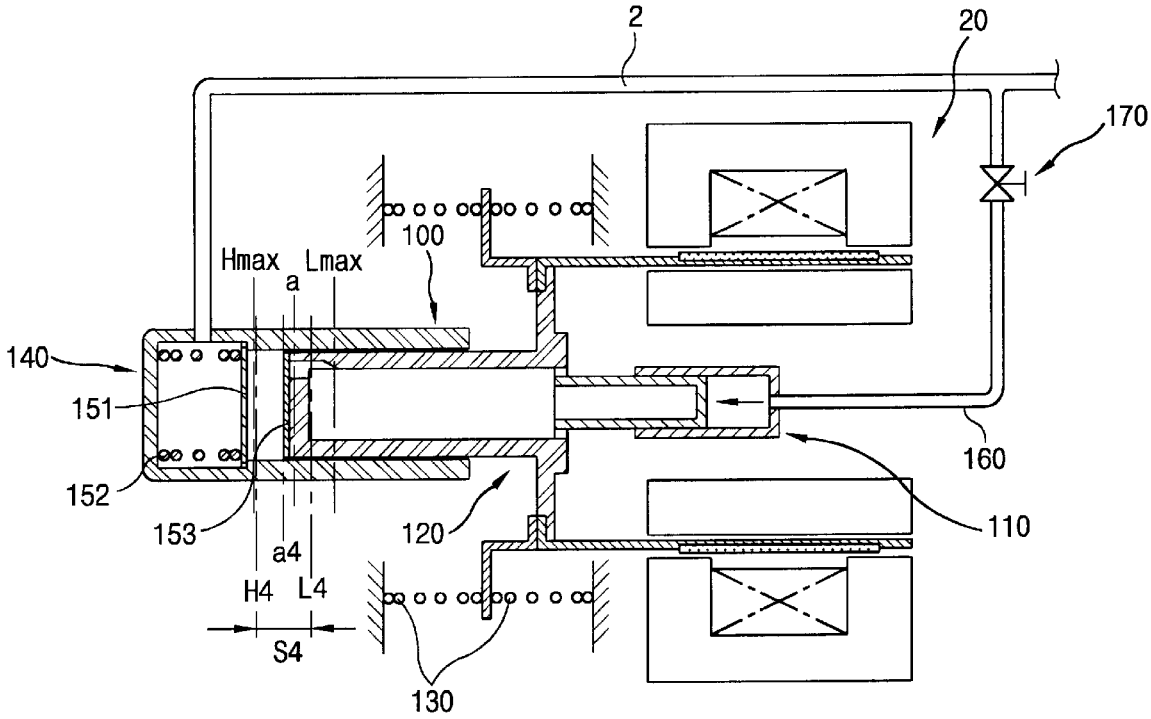
FIG. 6 is a sectional view showing a changed initial position (a4) and a stroke distance (S4) in case that there is relatively much amount of refrigerant gas compression amount when the refrigerant gas of the reciprocating compressor is compressed.

FIG. 6 is a sectional view showing a changed initial position (a4) and a stroke distance (S4) in case that there is relatively much amount of refrigerant gas compression amount when the refrigerant gas of the reciprocating compressor is compressed.

As shown in FIG. 6, in a state that the reference end portion of the initial position variable type piston 120 is positioned at the right center portion (a) between a maximum upper dead point ($H_{max}$) and a maximum lower dead point ($L_{max}$) if a much amount of refrigerant gas but less than the maximum available gas compression amount is to be compressed, the voltage of the power is controlled to have a stroke distance (S4) of the initial position variable type piston 120 suitable to the set compression amount, and at the same time, a portion of the high pressure refrigerant gas is introduced into the initial position controlling cylinder 110 by controlling the pressure control valve 170, so as to reach a pre-set pressure state.

When the reference end portion of the initial position variable type piston 120 is moved to be positioned at the reference position (a4), the initial position variable type piston 120 is moved to the upper dead point (H4) or to the lower dead point (L4) fitting the voltage control, thereby compressing the refrigerant gas.

Figure 7:
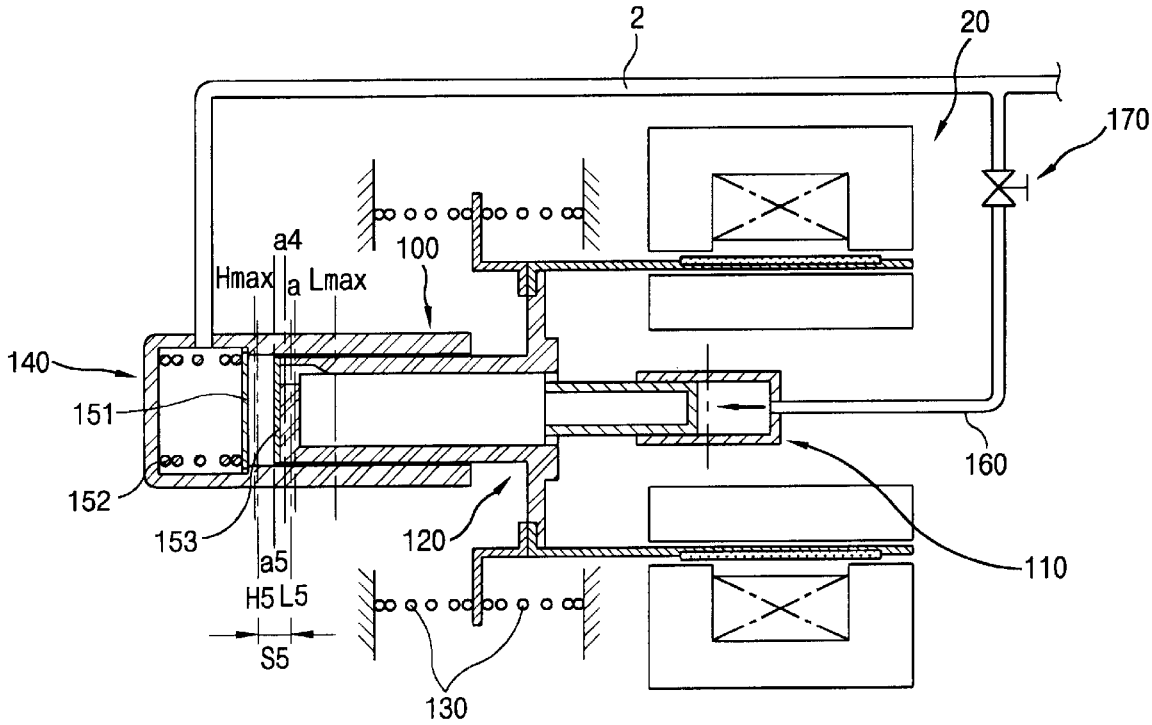
FIG. 7 is a sectional view showing a changed initial position (a5) and a stroke distance (S5) in case that there is relatively small amount of refrigerant gas compression amount when the refrigerant gas of the reciprocating compressor is compressed.

FIG. 7 is a sectional view showing a changed initial position (a5) and a stroke distance (S5) in case that there is relatively small amount of refrigerant gas compression amount when the refrigerant gas of the reciprocating compressor is compressed.

As shown in FIG. 7, if a less amount of refrigerant gas is compressed, the voltage of power is controlled to have a small stroke distance (S5) fitting the set compression amount of the refrigerant gas, and at the same time, the pressure control valve 170 is controlled to increase the pressure inside the initial position controlling cylinder 110. Then, the reference end portion of the initial position variable type piston 120 is moved from the set reference position (a4) to the compressing cylinder 100 so as to be positioned at the position (a5), where the piston 120 is reciprocally moved with the stroke distance (S5) to compress the refrigerant gas.

That is, the stroke distance of the initial position variable type piston 120 is controlled depending on the compression amount of the refrigerant gas to be discharged and also the initial position of the initial position variable type piston 120 is controlled, so that the top-clearance of the initial position variable type piston 120 can be continuously maintained at a certain distance.

Consequently, when the stroke distance is increased to compress relatively much amount of the refrigerant gas, the pressure inside the initial position controlling cylinder 110 is increased, so that the reference position of the initial position variable type piston 120 is moved toward the compressing cylinder 100 as much as the difference between the maximum stroke distance and the pre-set stroke distance, thereby constantly maintaining the top-clearance of the initial position variable type piston 120.

Meanwhile, when the stroke distance is reduced to compress a relatively small amount of refrigerant gas, the pressure inside the initial position controlling cylinder 110 is increased, so that the reference position of the initial position variable type piston 120 is moved toward to the compressing cylinder 100, thereby constantly maintaining the top-clearance of the initial position variable type piston 120.

Accordingly, even though the initial position of the initial position variable type piston 120 is changed by using the initial position controlling cylinder 110 for the compression amount of the compressed refrigerant gas to be discharged, the top-clearance of the initial position controlling piston 120 is constantly maintained, so that a dead volume can be reduced.

As so far described, the gas compression apparatus for reciprocating compressor of the present invention has many advantages.

That is, for example, first, the gas compression amount can be controlled by controlling the stroke distance of the initial position variable type piston according to the voltage control of the motor, and at the same time, by controlling the reference position of the initial position variable type piston for the stroke distance of the initial position variable type piston.

Secondly, since the top-clearance of the initial position variable type piston is constantly maintained, the refrigerant gas can be compressed as much as required, an efficiency of the system can be heightened by preventing a refrigerant gas compression loss.

Lastly, since the dead volume is minimized, an efficiency of the compressor can be improved by preventing a re-expansion loss.

As the present invention may be embodied in several forms without parting from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A gas compression apparatus for a reciprocating compressor comprising:

a reciprocating motor generating a linear reciprocal driving force;

a compressing cylinder positioned within a predetermined distance from the reciprocating motor;

a position controlling cylinder positioned within a predetermined distance from the compressing cylinder;

an initial position variable piston inserted into the compressing cylinder and the position controlling cylinder, the initial position variable piston being coupled to the reciprocating motor for receiving a driving force of the reciprocating motor and being linearly and reciprocally moved within the compressing cylinder and the position controlling cylinder;

a resonance spring inducing a resonance movement of the initial position variable piston;

a discharge cover coupled at an end portion of the compressing cylinder and forming a discharge chamber for discharging a compressed gas;

a valve unit for sucking gas into the compressing cylinder according to the linear reciprocating movement of the initial position variable piston and discharging the gas compressed in the compressing cylinder into the discharge chamber of the discharge cover;

a connection pipe for guiding a portion of the gas pressure discharged into the discharge chamber of the discharge cover to be introduced into the position controlling cylinder; and pressure controlling means being mounted at one side of the connection pipe and controlling a pressure inside the position controlling cylinder with the pressure of the gas discharged from the discharge chamber.

2. The apparatus of claim 1, wherein the position controlling cylinder comprises:

a cylinder body portion formed with one side closed;

an attachment portion formed bent and extended with a predetermined area at an end portion of the opening side of the cylinder body portion, the attachment portion having a plurality of gas through-holes; and a connection hole formed at one side of the cylinder body portion, to which one side of the connection pipe is coupled.

3. The apparatus of claim 1, wherein the initial position variable piston comprises:

a cylindrical body portion having a predetermined length with both ends closed, one of the ends being inserted into the compressing cylinder and the other of the ends being inserted into the initial position controlling cylinder;

a connection support formed to have a predetermined area to an outer circumference surface of the cylindrical body portion, supporting the resonance spring and being connected to the motor; and a gas suction passage having a suction hole formed at one side of the cylindrical body portion and an outflow hole through which refrigerant gas sucked into the suction hole is introduced into the compressing cylinder through the cylindrical body portion.

4. The apparatus of claim 1, wherein a discharge pipe for externally discharging a refrigerant gas is formed at one side of the discharge cover, and one side of the connection pipe communicates with the discharge pipe.

* * * * *